US005996931A

United States Patent [19]

Neveu et al.

[11] Patent Number: 5,996,931

[45] Date of Patent: Dec. 7, 1999

[54] DISPENSER INCLUDING AN INCLINED SUPPORT ROD FOR A WEB WOUND INTO A ROLL

[75] Inventors: Jean-Louis Neveu, Colmar; Bernard Louis Dit Picard, Amfreville-La-Campagne, both of France; Joseph Patrick O'Connor; Sebastian Conran, both of London, United Kingdom

[73] Assignee: Fort James B.V., Netherlands

[21] Appl. No.: 09/172,118

[22] Filed: Oct. 14, 1998

[51] Int. Cl.[6] ..... B65H 16/04

[52] U.S. Cl. ..... 242/597.5; 242/423.1; 242/597.8

[58] Field of Search ..... 242/423.1, 597, 242/597.5, 597.6, 597.7, 597.8; 312/34.8

[56] References Cited

U.S. PATENT DOCUMENTS

| | | | |
|---|---|---|---|
| 2,523,951 | 9/1950 | Graumlich | 242/423.1 |
| 2,661,165 | 12/1953 | Salmonson | 242/597 |
| 2,994,488 | 8/1961 | Waddell | 242/597.5 |
| 3,318,543 | 5/1967 | Moore | 242/423.1 |
| 4,373,682 | 2/1983 | Dickson | 242/597.5 |
| 5,628,474 | 5/1997 | Krueger et al. | 242/597.5 |
| 5,653,403 | 8/1997 | Ritchey | 242/597.5 |
| 5,743,485 | 4/1998 | Martorelli et al. | 242/597.5 |
| 5,799,895 | 9/1998 | Michaud et al. | 242/597.5 |
| 5,833,169 | 11/1998 | Morand | 242/597.6 |

*Primary Examiner*—Donald P. Walsh
*Assistant Examiner*—Emmanuel M. Marcelo
*Attorney, Agent, or Firm*—Breiner & Breiner

[57] ABSTRACT

A dispenser of a web wound into a roll includes a support rod and at least one substantially vertical wall, the support rod being inclined relative to a horizontal direction. The roll includes a central borehole which allows mounting of the roll on the support rod of the dispenser. The roll rests by one transverse end surface of the roll against the at least one substantially vertical wall of the dispenser.

14 Claims, 2 Drawing Sheets

DISPENSER INCLUDING AN INCLINED SUPPORT ROD FOR A WEB WOUND INTO A ROLL

FIELD OF THE INVENTION

The invention relates to a dispenser including an inclined support rod for a web wound into a roll.

BACKGROUND OF THE INVENTION

More particularly, the invention concerns a dispenser for a web wound on a roll, especially for paper such as cellulose wadding, of the kind wherein the roll includes a central borehole allowing mounting of the roll on a dispenser supporting rod. Illustratively, the dispenser is in the form of a case inside which is received the roll, a free end of the paper web in roll form being made to pass through an aperture in the dispenser.

By pulling on the free end of the paper web, the user unwinds the paper by rotating the roll about the axis of the support rod.

If the traction exerted by the user on the paper is fairly strong, the roll may be set in rotation about the support rod and, short of other design features, the kinetic energy then stored in the roll poses the risk of excessively unwinding the roll beyond the desired user length.

OBJECTS AND BRIEF DESCRIPTION OF THE INVENTION

An object of the invention is a dispenser for a web in roll form, the dispenser including means to decelerate the roll, with the means being simple and effective regardless of the operational geometry of the roll.

For that purpose, the invention provides the above described dispenser which is characterized in that the support rod slants relative to a horizontal direction and in that the roll rests at one of the roll's end surfaces against an essentially vertical wall of the dispenser.

The invention includes further features, namely:

- the roll rests against a friction area of the vertical dispenser wall,
- the friction area includes a set of projecting ribs,
- the ribs run substantially radially relative to the roll's axis,
- the dispenser is a closed dispenser receiving the roll between two substantially vertical transverse walls each fitted with a friction area against which the roll may come to rest,
- one friction area at one vertical dispenser wall is present near the higher axial end of the support rod and this friction area is located lower than the support rod,
- one friction area at one vertical dispenser wall is present near the lower axial end of the support rod and is located higher than the support rod,
- the support rod runs from a rear transverse dispenser wall in the forward and upward directions,
- the dispenser includes a removable cover forming the forward dispenser wall,
- the support rod can be mounted at one or more elevations in the dispenser,
- the web is wound on a central core of the roll, and
- the web is paper.

Other features and advantages are elucidated in the following description and in relation to its drawings.

DETAILED DESCRIPTION OF PRESENTLY PREFERRED EMBODIMENTS

Figure 1:
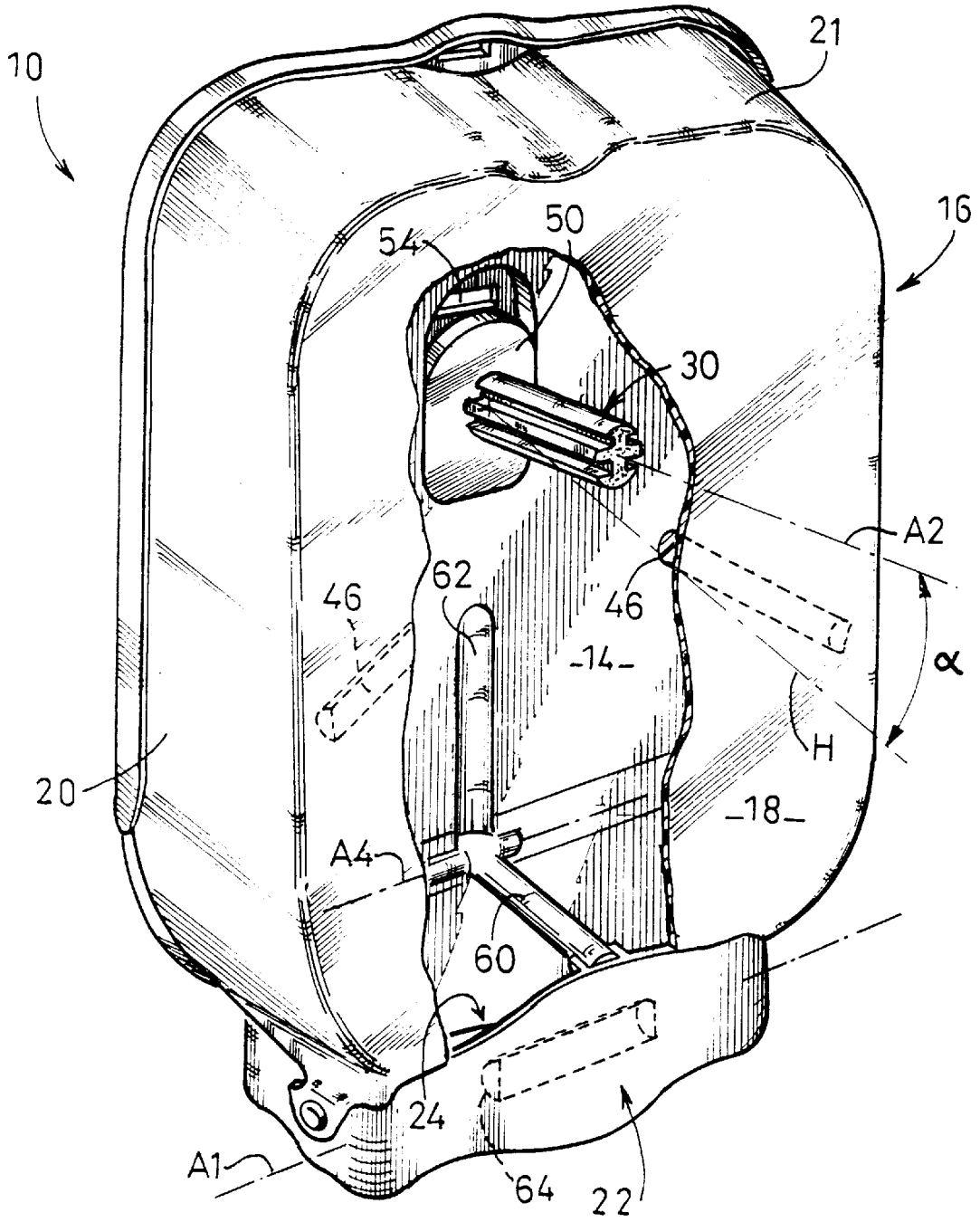
FIG. 1 is an exploded perspective of a dispenser of the invention.
Figure 2:
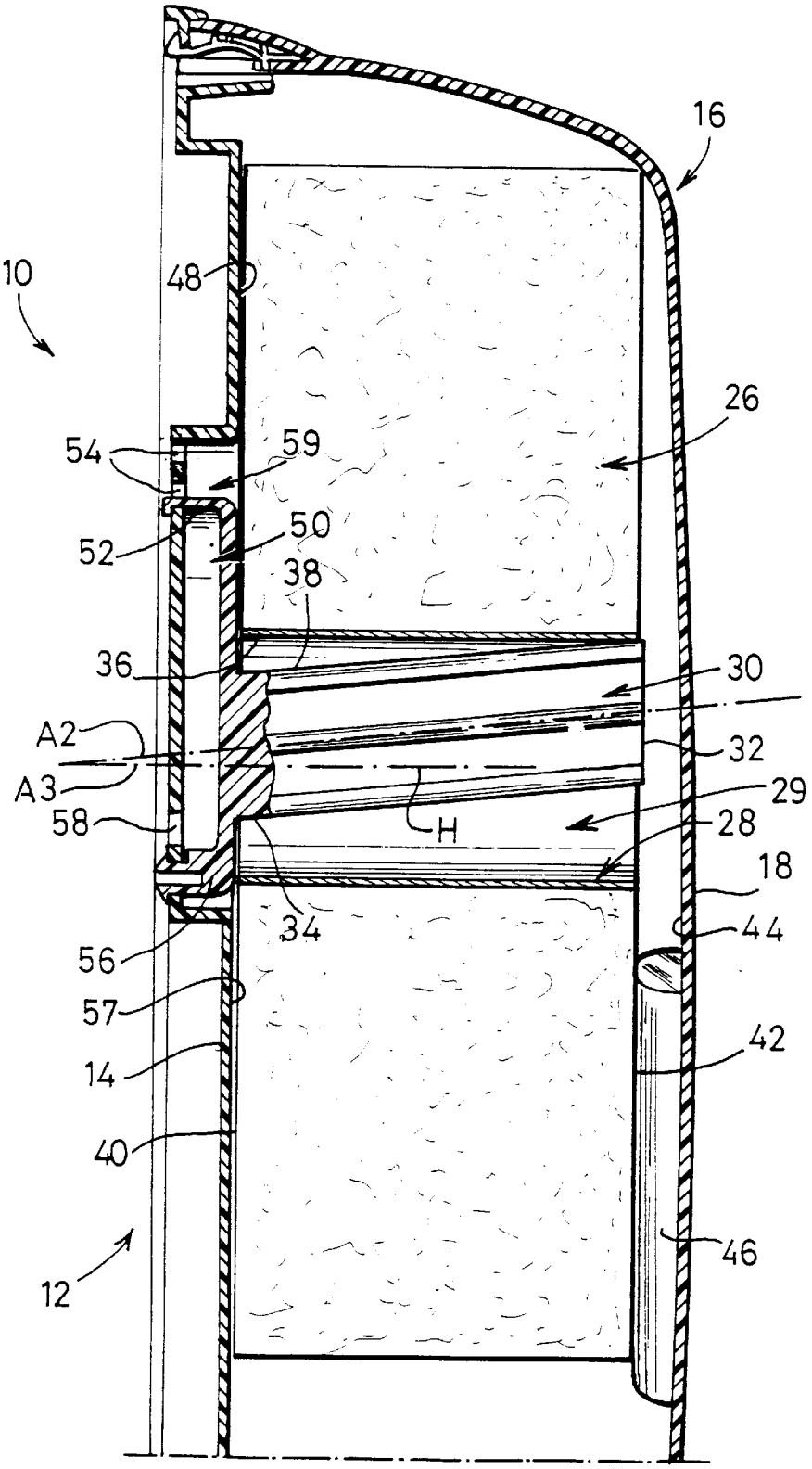
FIG. 2 is a partial cross-section in a vertical plane through the support rod of FIG. 1.

FIGS. 1 and 2 show a dispenser 10 dispensing a web from a roll, with particular application to paper rolls. The dispenser 10 takes the form of a case and, illustratively, is designed to house large rolls for community usage.

The dispenser 10 is mounted to a vertical building wall and includes a base 12 of which one vertical wall 14 runs along the building wall and forms the vertical rear wall of the case which is closed, in the forward direction, by a cover 16 pivotable by its lower end on the base 12 about a horizontal axis A1 substantially parallel to the building wall to which the dispenser 10 is affixed.

As shown in the Figures, the cover 16 includes a transverse wall 18, which at the front bounds the inside volume of the dispenser 10, and side walls 20, 21 which determine the depth of the case in a horizontal direction perpendicular to the building wall.

As shown more specifically in FIG. 1, the base 12 includes at its lower end a collar 22 bounding a lower aperture 24 of the dispenser 10. The paper web is unwound through this aperture 24 which opens downward.

As shown more specifically in FIG. 2, the dispenser 10 is designed to receive a roll 26 of web material.

The cylindrical roll 26 with axis A3 includes a tubular core 28 on which the web is wound. The winding so created has two lateral, transverse end surfaces 40, 42 which are substantially parallel to the transverse walls 14, 18 of the dispenser 10.

Accordingly, the tubular core 28 includes a central borehole 29 to allow mounting of the roll 26 on a support rod 30 running from the transverse rear wall 14 of the base 12 to the front.

In the design of the invention, the support rod 30 runs along an axis A2 contained in a vertical plane perpendicular to the building wall holding the dispenser 10 and subtending an angle a with a horizontal direction H such that the free front axial end 32 of the support rod 30 is located above its rear end which is connected to the base 12. Illustratively, the angle $\alpha$ is roughly 50° to 10°.

Accordingly, on account of its weight, the roll 26 rests at an angle on the support rod and tends to align itself with this angle by pivoting about a horizontal axis which is substantially perpendicular to the rod 30 until an upper generatrix 36 of the core 28 makes contact over its full length with an upper generatrix 38 of the support rod 30.

However, the depth of the dispenser 10 is designed to be slightly larger than the axial width of the paper web forming the roll 26. In this manner, the roll 26 tends to rest by the peripheral parts of its rear and front transverse end surfaces 40 and 42, respectively, against the rear and front transverse end surfaces 14 and 18 bounding the case of the dispenser 10.

More specifically, the inner surface 44 of the front wall 18 of the cover 16 includes two salient ribs 46 running in a substantially radial direction around the axis A2 of the support rod 30.

The ribs 46 run substantially at 120° relative to each other underneath the support rod 30. In cross-section, their contour is semi-cylindrical with the rounded portion cooperating with the transverse front end surface 42 of the roll.

Thus, the ribs 46 form a friction area touching the roll in such a manner that the axis A3 of the roll 26 remains substantially horizontal, the upper generatrix 36 of the core 28 in this case not being in contact over its entire length with the upper generatrix 38 of the support rod 30.

The ribs 46 allow limiting the contact surface between the roll 26 and the transverse front end surface wall 18. The ribs' rounded shape averts tearing the web material, in particular when the web is made of paper.

The roll 26 also rests by its transverse rear end surface 40 against a friction area 48 of the transverse rear wall 14 of the base 12. However, the friction area 48 of the transverse rear wall 14 is designed to be above the support rod 30.

Thanks to the invention, the roll 26 therefore rests, essentially by peripheral portions of its transverse end surfaces 40, 42, against friction areas 46, 48 of the dispenser 10.

As a result, the torque applied by the roll 26 rubbing against the walls 14, 18 of the dispenser decreases with the diameter of the roll 26. Thus, as the roll unwinds, the opposing force allowing deceleration of the roll concurrently decreases with the decrease of roll moment of inertia.

Furthermore, by using an inclined support rod, resting of the roller 26 by its transverse surfaces 40, 42 against the transverse dispenser walls 14, 18 is assured regardless of roll warping, that is regardless of the precise geometry of the transverse surfaces 40, 42, such geometry possibly being irregular in relation to changes in axial positioning during winding between the paper web and the core 28.

In another feature of the invention, the support rod 30 can be positioned at various heights within the dispenser 10. In the embodiment shown in the Figures, the rod 30 can be located in two different, discrete positions. However, the support rod also can be mounted in a slide affixed to the base and be fitted with locking means allowing the rod to be mounted at different heights.

In the embodiment shown in the Figures, the support rod 30 includes at its rear axial end 34 a transverse plate 50 fitted at its upper end with at least one upper hook 52 to be engaged in one of two slots 54 in the rear transverse wall 14 of the base 12 and at its lower end with at least one lower stud 56 which can elastically nest in one of two corresponding orifices 58 which also are present in the transverse rear wall 14.

Obviously, the slots 54 and the orifices 58 are designed pairwise in such a manner that when the downward-curving upper hook 52 is engaged into a substantially horizontal slot 54, the stud 56 axially nests in the corresponding orifice 58 to secure affixation of the plate 50.

More specifically, an inside surface 57 of the rear transverse wall 14 includes a reinforcement 59 having the slots 54 and orifices 58 at its ends and receiving the plate 50 in such a way that plate 50 does project forward from the inside surface 57.

As shown in FIG. 1, the dispenser 10 includes an auxiliary, retractable support rod 60 mounted approximately at the level of the collar 22, to the lower end of the dispenser 10.

The auxiliary rod 60 hinges about a horizontal and transverse axis A4 on the rear wall 14 of the base 12 and can be moved vertically upward, substantially into the plane of wall 14 to be received in a corresponding housing 62 in the rear wall 14. In its lowered position, the auxiliary rod 60 runs through the lower aperture 24.

When almost entirely unwound, a roll 26 is received by the auxiliary rod 60. In this manner such a roll can be terminated while a new one can be mounted on the main support rod 30 in such a way that when the first roll is terminated, the user can resort to the second roll without feed interruption.

As shown in FIG. 1, optionally, the inside surface of the collar 22 can be also fitted with a friction rib 64 to decelerate the roll mounted on the auxiliary rod 60.

As will be apparent to one skilled in the art, various modifications can be made within the scope of the aforesaid description. Such modifications being within the ability of one skilled in the art form a part of the present invention and are embraced by the appended claims.

It is claimed:

1. A dispenser of a web wound into a roll, wherein the roll comprises a central borehole which allows mounting of the roll on a support rod of the dispenser; wherein the dispenser comprises the support rod and at least one substantially vertical wall, the support rod being inclined relative to a horizontal direction; and wherein the roll rests by one transverse end surface of the roll against the at least one substantially vertical wall of the dispenser in such a manner that an axis of rotation of the roll remains substantially horizontal.

2. Dispenser as claimed in claim 1 wherein the dispenser further comprises a friction area on the at least one substantially vertical wall of the dispenser, and wherein the roll rests at one transverse end of the roll against the friction area.

3. A dispenser of a web wound into a roll, wherein the roll comprises a central borehole which allows mounting of the roll on a support rod of the dispenser; wherein the dispenser comprises the support rod and at least one substantially vertical wall, the support rod being inclined relative to a horizontal direction; wherein the roll rests by one transverse end surface of the roll against the at least one substantially vertical wall of the dispenser; and wherein the dispenser further comprises a friction area on the at least one substantially vertical wall of the dispenser, and the roll rests at one transverse end of the roll against the friction area, said friction area comprising a set of salient ribs.

4. Dispenser as claimed in claim 3 wherein the salient ribs extend substantially radially to an axis of the roll.

5. Dispenser as claimed in any one of claims 2, 3 or 4 wherein the dispenser is a closed dispenser receiving the roll between two substantially vertical transverse walls, and wherein each of the two substantially vertical transverse walls includes a friction area with which the roll can contact.

6. Dispenser as claimed in claim 5 wherein each friction area is present on a different transverse wall of the dispenser, with one friction area being on a transverse wall onto which a lower axial end of the support rod is attached and being located higher than the support rod in the dispenser, and with one friction area being on a transverse wall adjacent a higher axial end of the support rod and being located lower than the support rod in the dispenser.

7. Dispenser as claimed in any one of claims 2, 3 or 4 wherein the friction area is present on a transverse wall of the dispenser on a side of the support rod having a higher axial end and the friction area is positioned lower than the support rod in the dispenser.

8. Dispenser as claimed in any one of claims 2, 3 or 4 wherein the friction area is present on a transverse wall of the dispenser onto which a lower axial end of the support rod is attached and the friction area is located.

9. Dispenser as claimed in any one of claims 1 or 2 wherein the support rod runs in a direction upward and forward from a rear transverse wall of the dispenser.

10. Dispenser as claimed in claim 9 wherein the dispenser further comprises a removable cover forming a transverse front wall for the dispenser.

11. Dispenser as claimed in claim 1 wherein the support rod is mountable at one or more elevations within the dispenser.

12. Dispenser as claimed in any one of the claims 3, or 4 wherein the support rod runs in a direction upward and forward from a rear transverse wall of the dispenser.

13. Dispenser as claimed in claim 12 wherein the dispenser further comprises a removable cover forming a transverse front wall for the dispenser.

14. Dispenser as claimed in claim 3 wherein the support rod is mountable at one or more elevations within the dispenser.

* * * * *